US008864536B2

(12) United States Patent
Hoffmeyer

(10) Patent No.: US 8,864,536 B2
(45) Date of Patent: Oct. 21, 2014

(54) IMPLEMENTING HYBRID MOLDED SOLDER-EMBEDDED PIN CONTACTS AND CONNECTORS

(75) Inventor: Mark K. Hoffmeyer, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 85 days.

(21) Appl. No.: 13/463,185

(22) Filed: May 3, 2012

(65) Prior Publication Data

US 2013/0295797 A1 Nov. 7, 2013

(51) Int. Cl.
*H01R 9/24* (2006.01)
*H01R 13/02* (2006.01)

(52) U.S. Cl.
USPC ..... 439/884; 439/82

(58) Field of Classification Search
USPC ..... 439/884, 886, 82, 83, 751
See application file for complete search history.

(56) References Cited

U.S. PATENT DOCUMENTS

| | | | | |
|---|---|---|---|---|
| 4,644,643 | A | 2/1987 | Sudo | |
| 4,767,344 | A * | 8/1988 | Noschese | 439/83 |
| 5,029,748 | A * | 7/1991 | Lauterbach et al. | 228/180.1 |
| 5,130,164 | A | 7/1992 | Hutchison et al. | |
| 5,957,736 | A * | 9/1999 | Moriuchi et al. | 439/876 |
| 5,971,058 | A | 10/1999 | Bolde et al. | |
| 6,179,631 | B1 | 1/2001 | Downes et al. | |
| 6,528,873 | B1 | 3/2003 | Heinen | |
| 6,902,102 | B2 * | 6/2005 | Tanabe et al. | 228/260 |
| 7,172,438 | B2 * | 2/2007 | Vicich et al. | 439/83 |
| 7,275,315 | B2 * | 10/2007 | Modinger | 29/843 |
| 7,820,543 | B2 | 10/2010 | Chang et al. | |
| 8,007,292 | B2 * | 8/2011 | Kunert | 439/83 |
| 8,487,183 | B2 * | 7/2013 | Schulte et al. | 174/94 R |
| 2010/0048044 | A1 * | 2/2010 | Kunert | 439/82 |

FOREIGN PATENT DOCUMENTS

| | | |
|---|---|---|
| JP | 1183084 | 7/1989 |
| JP | 2035762 | 3/1990 |
| JP | 10335811 | 5/1997 |
| JP | 3062960 | 7/1999 |
| JP | 2001217342 | 8/2001 |
| JP | 4184888 | 9/2008 |

* cited by examiner

*Primary Examiner* — Hae Moon Hyeon
(74) *Attorney, Agent, or Firm* — Joan Pennington

(57) ABSTRACT

A method and structures for implementing hybrid molded solder-embedded pin contacts and connectors. An injection molded solder (IMS) mold cavity receives a Pin-In-Hole (PIH) connector pin. A lead-free solder is injection molded into the IMS mold cavity embedding and surrounding the PIH connector pin and forming a predefined molded solder shape defined by the PIH connector pin and the IMS mold cavity.

9 Claims, 6 Drawing Sheets

IMPLEMENTING HYBRID MOLDED SOLDER-EMBEDDED PIN CONTACTS AND CONNECTORS

FIELD OF THE INVENTION

The present invention relates generally to the data processing field, and more particularly, to a method, and structures for implementing hybrid molded solder-embedded pin contacts and connectors.

DESCRIPTION OF THE RELATED ART

Large, thick cross section printed circuit boards (PCBs) that possess a mixture of soldered surface mount components are challenging to assemble, and especially so if Pin-In-Hole (PIH) connectors are also required on them to facilitate interconnection to other boards or cables in a given electronics application. With the advent of lead-free (Pb-Free) solder processing requirements and associated environmental Restriction of Hazardous Substances (RoHS) legislation that bans lead in the assembly of electronic components, PIH assembly challenges cannot be adequately, practically or reliably addressed for boards in excess of 150 mils or 3.75 mm thick.

A sufficient amount of solder hole fill on PIH connection pins simply cannot be achieved to ensure interconnection reliability. In fact, on boards that are 120 mils thick, it is difficult to achieve a minimum 50% hole fill through the via section on many board applications, even when using the latest advances in Pb-Free wave solder materials, fluxing systems, and wave soldering equipment. This hole fill issue becomes especially significant if PIH connectors must provide connection to signals when large thick layers of copper ground and voltage planes within the PCBs exist, since the process heat facilitated during the assembly operation that drives solder wetting and climb into the barrels to facilitate connections from solder hole fill is continuously robbed from the local fill area by the large highly conductive masses of copper within the PCB construction.

As power requirements continue to rise for high performance computer CPU, I/O, and memory sub- systems, the Pb-Free assembly process limitations will create multiple and significant design challenges for upcoming server systems, and for other complex systems that must rely in part on PIH connector assembly, as these connector types typically enable more efficient power distribution and current carrying capability and are more readily available for high power applications than their connector counterparts made in compliant pin or surface mount technology (SMT) form factors.

However, conventional PIH connector types cannot be reliably or practically processed, or used on boards in excess of 150 mils thick when coupled with Pb-Free solders. A preferred PIH connector system that has design attributes sufficient to adequately distribute the massive power requirements for this subsystem can be provided by the supply chain, but the existing PIH connector technology simply cannot be reliably processed on an extremely thick, such as 5-6 mm, board cross section.

At present, alternate PIH connector constructions that offer a solution to the present Pb-Free PIH assembly limitations do not exist. Moreover, alternate interconnect solutions such as SMT or compliant pin connector types either do not exist in densities required for these applications, and/or they also create multiple assembly complexities and reliability concerns as well.

One known connector technology that has been generally abandoned for future systems development efforts when used in large form factors as it drives multiple assembly complexities reliability concerns, has a thermal mass that does not facilitate an assembly process window for temperature sensitive components when cards are assembled using commercially available, plan of record Pb-Free tin-silver-copper (Sn—Ag—Cu) solders or (SAC) solders.

A need exists for effective structures for implementing solder-embedded pin contacts and connectors for use with lead-free (Pb-F) solder processing requirements and thick cross section printed circuit boards (PCBs). It is desirable to provide such structures for implementing solder-embedded pin contacts and connectors that have a generally simple configuration and are generally easy to assemble and that are inexpensive to produce.

SUMMARY OF THE INVENTION

Principal aspects of the present invention are to provide a method, and structures for implementing hybrid molded solder-embedded pin contacts and connectors. Other important aspects of the present invention are to provide such method and structures substantially without negative effects and to overcome many of the disadvantages of prior art arrangements.

In brief, a method, and structures for implementing hybrid molded solder-embedded pin contacts and connectors. An injection molded solder (IMS) mold cavity receives a Pin-In-Hole (PIH) connector pin. A lead-free solder is injection molded into the IMS mold cavity embedding and surrounding the PIH connector pin and forming a predefined molded solder shape defined by the PIH connector pin and the IMS mold cavity.

In accordance with features of the invention, the predefined molded solder shape includes a generally cylindrical shape embedding and surrounding the PIH connector pin.

In accordance with features of the invention, the predefined molded solder shape embedding and surrounding the PIH connector pin optionally includes a square, hexagonal or other shape suitable for a molding process.

In accordance with features of the invention, the PIH connector pin embedded and surrounded with the predefined molded solder shape of lead-free solder is provided for press fit or near press fit insertion into a component connection hole. Then a connection process includes conventional wave soldering process flows or surface mount technology (SMT) processing.

In accordance with features of the invention, the predefined molded solder shape is metallurgically bonded to the PIH connector pin, then the hybrid molded solder-embedded pin contact is inserted into a corresponding PIH barrel on a thick cross section printed circuit board (PCB).

In accordance with features of the invention, a plurality of the hybrid molded solder-embedded pin contacts are incorporated into a connector or connector wafer array housing, and then inserted into corresponding PIH barrels on a thick PCB.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In the following detailed description of embodiments of the invention, reference is made to the accompanying drawings, which illustrate example embodiments by which the invention may be practiced. It is to be understood that other embodiments may be utilized and structural changes may be made without departing from the scope of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In accordance with features of the invention, a method, and structures are provided for implementing hybrid molded solder-embedded pin contacts and connectors.

Figure 1:
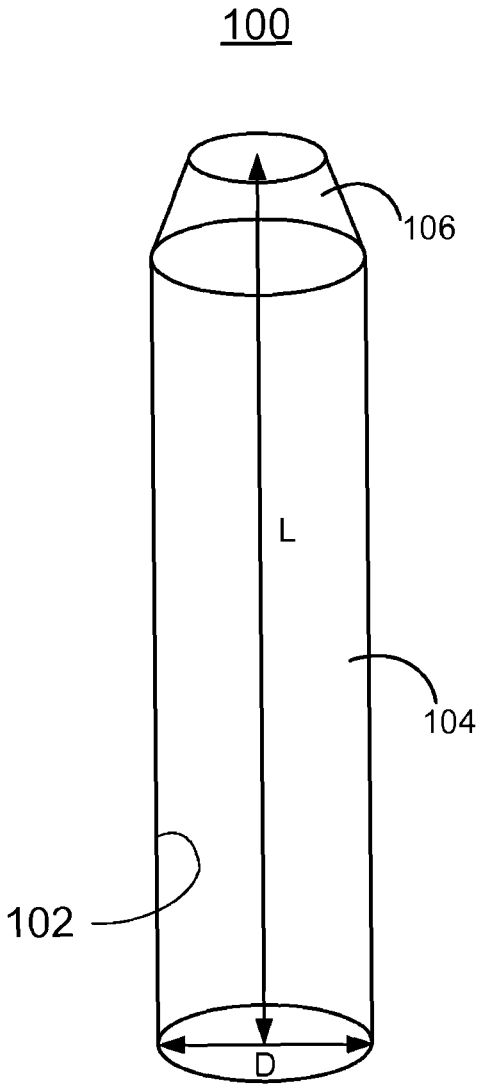
FIG. 1 is a perspective view not to scale of an example injection molded solder (IMS) mold defining an example IMS mold cavity for implementing hybrid molded solder-embedded pin contacts and connectors in accordance with a preferred embodiment.

Having reference now to the drawings, in FIG. 1 there is shown not to scale an example injection molded solder (IMS) mold designated by the reference character 100 for implementing hybrid molded solder-embedded pin contacts and connectors generally in accordance with a preferred embodiment.

Figure 2:
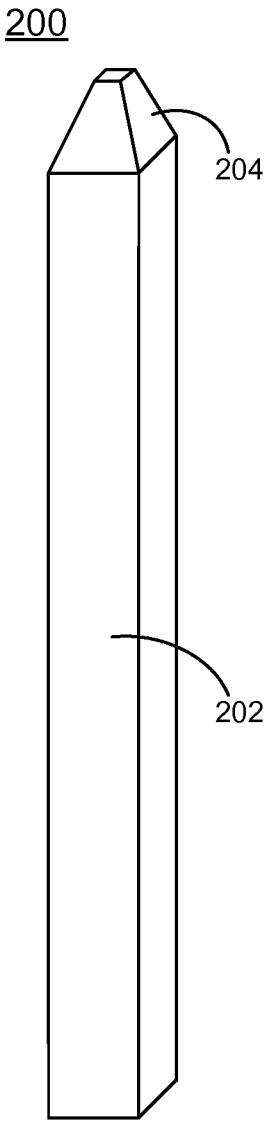
FIG. 2 is a perspective view not to scale illustrating an example portion of a Pin-In-Hole (PIH) connector pin used for implementing hybrid molded solder-embedded pin contacts and connectors in accordance with a preferred embodiment.

Referring to FIG. 1, the IMS mold 100 defines an example IMS mold cavity 102 for receiving a portion of a connector pin used for Pin-In-Hole (PIH) soldering, such as the portion of PIH connector pin 200 illustrated and described with respect to FIG. 2.

As shown, the IMS mold cavity 102 includes an elongated cylindrical shaped portion 104 and a tapered end portion 106. The IMS mold cavity 102 has an overall length indicated by an arrow labelled L and a base width indicated by an arrow labelled D.

The IMS mold cavity 102 has a selected geometry and size for defining a predefined molded solder embedding and surrounding a PIH connector pin along a pin portion with the lead-free solder forming a predefined molded solder shape of the solder embedded PIH connector pin for insertion into a corresponding PIH barrel on a printed circuit board (PCB). For example, the illustrated IMS mold cavity 102 provides the generally cylindrical solder shape embedding and surrounding the PIH portion of the connector pin.

It should be understood that the present invention is not limited to the illustrated IMS mold 100, and the molded solder shape defined by the IMS mold cavity 102 optionally includes a square, hexagonal or other shape suitable for molding embedding and surrounding the PIH connector pin. It should be understood that the present invention can be used for individually molding solder on stand alone pins or an array of stand alone pins, and the present invention can be used for molding solder on an array of pins already inserted into a connector housing.

Referring to FIG. 2, the illustrated PIH portion of a connector pin 200 includes an elongated rectangular shaped portion 202 and a tapered end portion 204.

Figure 3:
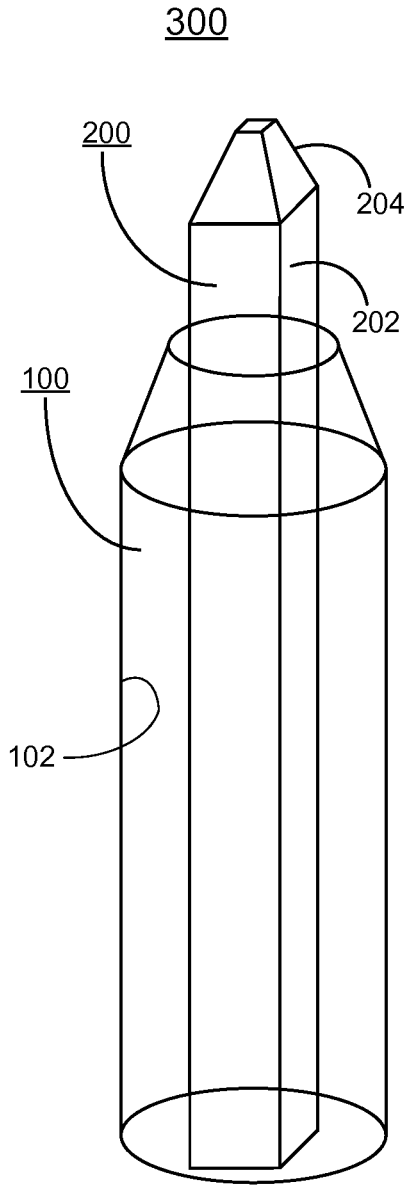
FIG. 3 is a perspective view not to scale further illustrating the example portion of the PIH connector pin of FIG. 2 received with the example IMS mold cavity for implementing hybrid molded solder-embedded pin contacts and connectors in accordance with a preferred embodiment.

Referring also to FIG. 3, a perspective view not to scale further illustrating an example assembly 300 of the PIH portion of connector pin 200 received with the IMS mold cavity 102 for implementing hybrid molded solder-embedded pin contacts and connectors in accordance with a preferred embodiment.

In accordance with features of the invention, using the example assembly 300 a liquid lead-free or other pure metal or solder alloy composition is injection molded into the IMS mold cavity 102 embedding and surrounding the PIH portion of connector pin 200 to form a predefined molded solder shape defined by the PIH portion of connector pin 200 and the IMS mold cavity 102. The injection molded lead-free solder is metallurgically bonded to the solder embedded PIH portion of connector pin 200.

An injection molding process or similar molding process is adapted for the creation of the novel hybrid molded solder-embedded pin contacts and connectors in accordance with a preferred embodiment. For example, U.S. Pat. No. 5,971,058 to Bolde et al., issued Oct. 26, 1999, and assigned to the present assignee teaches an injection molded solder (IMS) apparatus and method for continuous casting solder onto discrete parts.

In accordance with features of the invention, a modification of the IMS technology is used to provide a process to embed long PIH connector solder pins 200 or other pins in a geometry of Pb-F solder that facilitates subsequent insertion and successful soldering of the pins into thick, high thermal mass complex board cross sections. The use of the IMS process in conjunction with conventional contact pins enables the creation of novel hybrid molded solder embedded pins of the invention that can be used individually or within large or small scale PIH connectors for assembly to thick cross section PCBs. Moreover, the IMS process can be customized for use on individual pins or arrays of individual pins, and pins that are pre-inserted into connector bodies or connector housings as well.

The novel hybrid molded solder embedded pins 200 of the invention advantageously are created and processed using similar IMS technology as described in the above identified U.S. Pat. No. 5,971,058. The subject matter of the above identified U.S. Pat. No. 5,971,058 is incorporated herein by reference.

Figure 4:
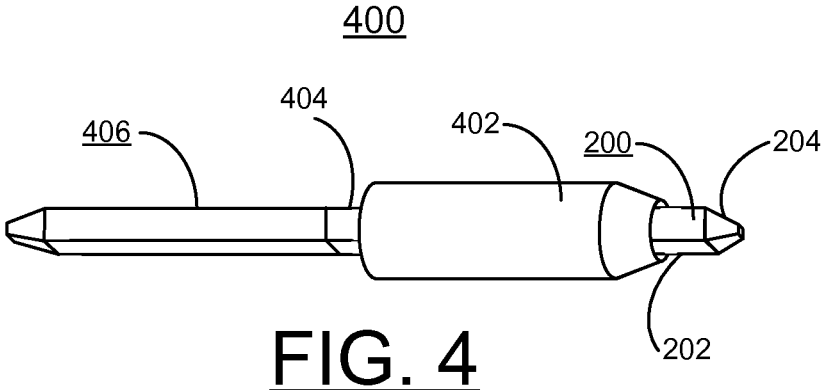
FIG. 4 is a perspective view not to scale illustrating an example hybrid molded solder-embedded pin contact including the PIH connector pin portion shown in FIG. 2 together with an injection molded lead-free solder forming a predefined molded solder shape defined by the PIH connector pin and the IMS mold cavity of FIG. 1, the separable mating contact interface portion possessing a noble separable contact finish, and a diffusion barrier for implementing hybrid molded solder-embedded pin contacts and connectors in accordance with a preferred embodiment.

Referring to FIG. 4, there is shown a perspective view not to scale illustrating an example hybrid molded solder-embedded pin contact generally designated by the reference character 400. The hybrid molded solder-embedded pin contact 400 includes the PIH connector pin portion 200 together with solder 402 injection molded into the IMS mold cavity 102 in the mold assembly 300 of FIG. 3.

The IMS solder 402 embedding and surrounding the PIH connector pin 200 has a predefined molded solder shape defined by the PIH connector pin 200 and the IMS mold cavity 102 for implementing hybrid molded solder-embedded pin contacts and connectors in accordance with a preferred embodiment.

As shown, the predefined molded solder 402 includes a generally cylindrical shape embedding and surrounding the PIH connector pin 200. The predefined molded solder shape optionally includes a square, hexagonal or other shape suitable for molding embedding and surrounding the PIH connector pin. The hybrid molded solder-embedded pin contact 400 includes a mid-section wetting barrier layer 404, and separable contact surfaces generally designated by the reference character 406, with surfaces 406 possessing a noble separable contact finish, for example, including an Au/Ni plated option, an Au/Pd/Ni option, or an Sn/Ni plated option.

The predefined molded solder 402 has a tapered cylindrical injection molded solder geometry that is used on the pin 200 to facilitate a hole insertion lead in that is in proximity to a lead in taper portion 204 on the embedded contact pins. The predefined molded solder 402 includes a selected one of various solder compositions on the hybrid embedded pin contact 400 to facilitate a hierarchy of solder reflow process temperatures when necessary in certain applications that must undergo multiple reflow steps or possess temperature sensitive devices. The selected solder composition is based upon, for example, a solder reflow temperature for an associated PCB or a hierarchy of solder reflow process temperatures for multiple reflow steps, or a device temperature of a temperature sensitive device. The selected solder composition includes, for example, a lead-free tin-silver-copper (Sn—Ag—Cu) solder or (SAC) solder.

The PIH connector pin 200 can be made of numerous metals including, for example, Iron Nickel (Fe/Ni) or copper (Cu) based alloys. Depending on base metal of pin 200, the pins optionally receive a uniform under-plating layer to enable solder wetting, and to facilitate the diffusion barrier 404 and plating acceptance layer for the final top plated layer to be used on the separable interface portion 406 of the hybrid molded solder-embedded pin contact 400.

The separable contact surfaces 406 of the contact pins 400 optionally includes of a selected one of many types of connector contact geometries, for example a flat header blade surfaces, or cantilever beams, right angle pins, and the like. The pin geometries of the separable contact surfaces 406 optionally also include one of multiple different typical finishes used for contact mating such as Au/Ni, Au/Pd/Ni and Sn/Ni surface finishes. It is useful to provide the barrier 404 with a width of pin base metal or Ni under-plating between the separable mating portion 406 of the pin 400 and the IMS processed PIH pin 200 to act as a wetting dam to prevent excess solder wicking onto the mating regions of the pin surfaces 406 during the IMS pin embedding process and subsequent board assembly soldering steps after insertion into an associated printed circuit board, as shown in FIG. 6.

In accordance with features of the invention, by creating the new hybrid injection molded solder-pin structure 400 adequate solder fill is supplied by the pin itself, therefore allowing for heat transfer from the wave solder process to transfer through the solder 402 on the pin 200 to drive full wetting of the pre-applied pin solder to the complete thickness cross section of PIH connector barrels on boards that are in excess of 150 mils thick. Alternatively, adequate solder is also present to facilitate soldering and solder wetting into board PIH connector barrels by using conventional vapor phase or convection reflow processes typically used for attach of surface mount technology (SMT devices as well.

Figure 5:
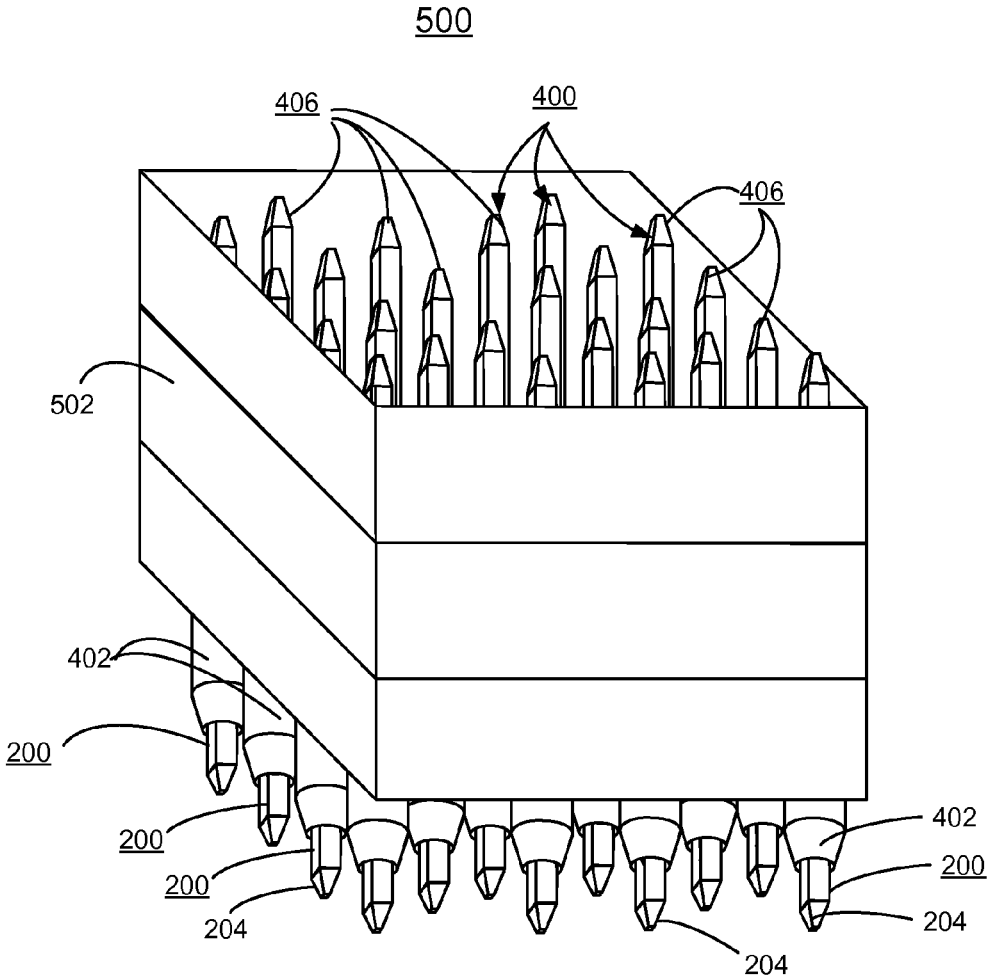
FIG. 5 is a perspective view not to scale further illustrating an example connector including a plurality of example hybrid molded solder-embedded pin contacts in accordance with a preferred embodiment.

Referring to FIG. 5, there is shown a perspective view not to scale further illustrating an example connector generally designated by the reference character 500 including a plurality of the hybrid molded solder-embedded pin contacts 400 in accordance with a preferred embodiment. The connector 500 includes a connector or connector wafer array housing 502. As shown, the hybrid molded solder-embedded pin contacts 400 include the separable contact surfaces 406 extending upwardly from the illustrated housing 502 and the predefined molded solder shape 402 embedding and surrounding connection pins 200 with the pin portions 204 extending downwardly from the housing 502 for insertion into a printed circuit board (PCB), such as illustrated in FIG. 6.

Figure 6:
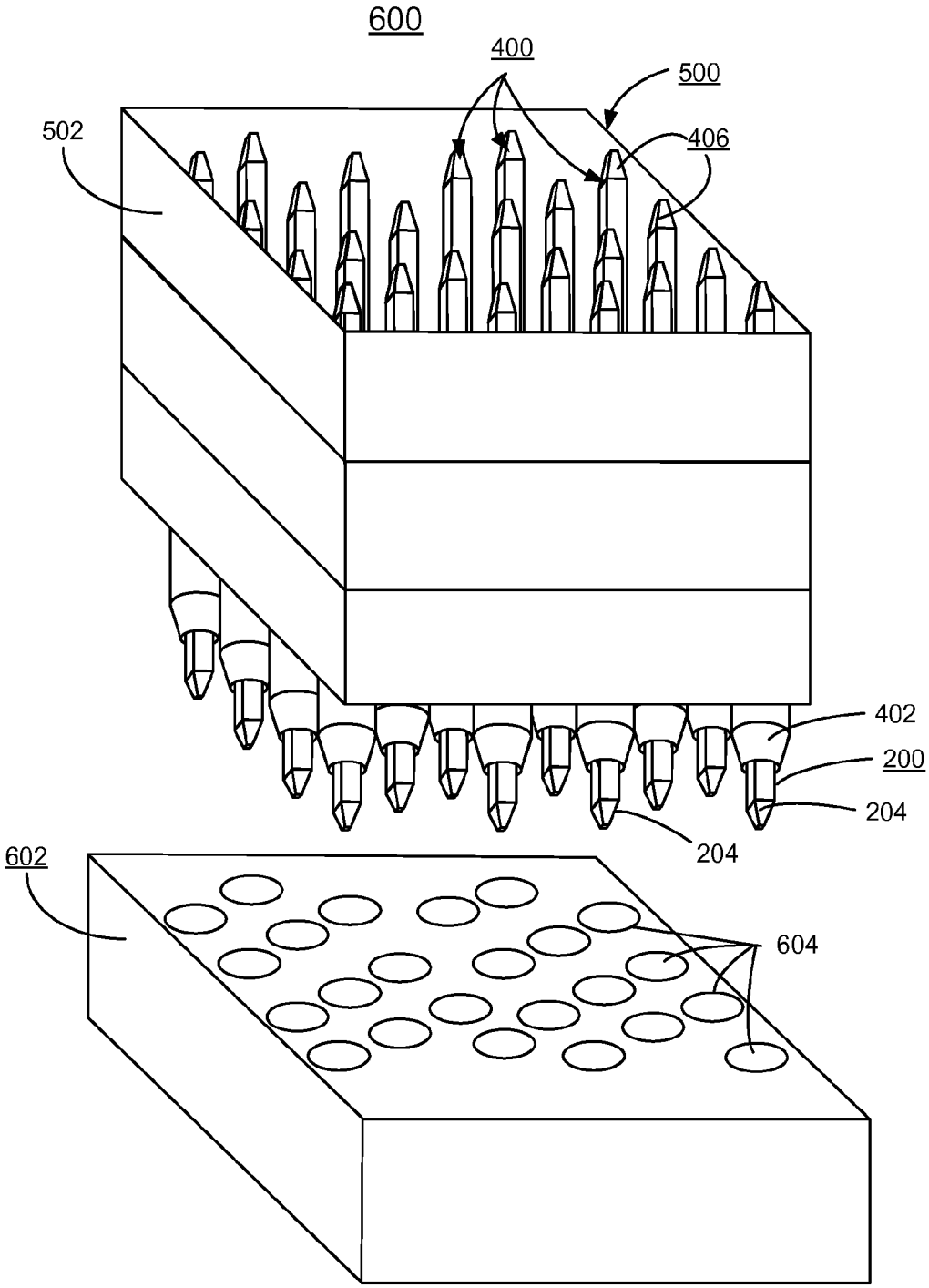
FIG. 6 is a perspective view not to scale further illustrating the example connector including the plurality of example hybrid molded solder-embedded pin contacts of FIG. 5 to be inserted into corresponding PIH barrels on a thick cross section printed circuit board (PCB) in accordance with a preferred embodiment.

Referring to FIG. 6, there is shown a perspective view not to scale illustrating an example assembly generally designated by the reference character 600 further illustrating the example connector 500 together with a printed circuit board (PCB) 602. The connector 500 includes the plurality of hybrid molded solder-embedded pin contacts 400 to be inserted into a plurality of corresponding PIH barrels 604 on the thick cross section PCB 604 in accordance with a preferred embodiment.

Once any given form factor of the pin contact 400 and connector 500 are created, the PIH pin 200 or PIH pins 200 of connector 500 are then inserted into the board connector component holes or corresponding PIH barrel 604 of the PCB 602 and can be processed using conventional wave soldering process flows or SMT processing as well. In either instance, the tapered cylindrical injection molded solder geometry advantageously used on PIH pin 200 of the pin contact 400 facilitates a hole insertion lead in that is in proximity to the lead in taper 204 on the embedded contact pin 400. Depending on geometry of solder 402 used for embedding the PIH pin 200, a press fit or near press fit design advantageously is created for use in conventional SMT reflow operations as well. In this case, a prescribed or conventional pre-fluxing of board holes 604 preferably is used similar to that provided for wave solder operations.

While the present invention has been described with reference to the details of the embodiments of the invention shown in the drawing, these details are not intended to limit the scope of the invention as claimed in the appended claims.

What is claimed is:

1. A structure for implementing hybrid molded solder-embedded pin contacts and connectors comprising:

a Pin-In-Hole (PIH) connector pin including an elongated portion and a tapered end portion; and a lead-free solder embedding and surrounding said PIH connector pin substantially along said elongated portion, said lead-free solder forming a predefined molded solder shape of said solder embedded PIH connector pin for press fit insertion into a corresponding PIH barrel on a printed circuit board (PCB); said PCB including a thick PCB, having a thickness in excess of 3.75 mm; said lead-free solder including a selected solder composition based upon a solder reflow temperature of a hierarchy of solder reflow process temperatures for multiple reflow steps and a temperature sensitive device; and said selected solder composition including a lead-free tin-silver-copper (Sn—Ag—Cu) solder.

2. The structure as recited in claim 1 wherein said predefined molded solder shape of said solder embedded PIH connector pin enables effective and reliable signal connection to the corresponding PIH barrel on said printed circuit board (PCB).

3. The structure as recited in claim 1 wherein said predefined molded solder shape includes a generally cylindrical shape.

4. The structure as recited in claim 1 wherein said predefined molded solder shape embedding and surrounding the PIH connector pin elongated portion includes a selected shape suitable for molding.

5. The structure as recited in claim 1 includes a plurality of said PIH connector pins inserted into a connector housing.

6. The structure as recited in claim 1 wherein said predefined molded solder shape is metallurgically bonded to said solder embedded PIH connector pin.

7. The structure as recited in claim 1 wherein said solder embedded PIH connector pin includes a separable mating pin portion having a selected connector contact geometry.

8. The structure as recited in claim 7 includes a diffusion barrier separating said elongated portion of said solder embedded PIH connector pin and said separable mating pin portion, said diffusion barrier preventing solder wicking onto said separable mating pin portion.

9. The structure as recited in claim 7 wherein said separable mating pin portion having said selected connector contact geometry and including a selected plating.

* * * * *